US010659872B2

(12) United States Patent
Je

(10) Patent No.: US 10,659,872 B2
(45) **Date of Patent: *May 19, 2020**

(54) SPEAKER APPARATUS

(71) Applicant: SAMSUNG ELECTRONICS CO., LTD., Suwon-si (KR)

(72) Inventor: Byoung Soo Je, Uiwang-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/518,483

(22) Filed: Jul. 22, 2019

(65) Prior Publication Data

US 2019/0349673 A1 Nov. 14, 2019

Related U.S. Application Data

(63) Continuation of application No. 16/059,648, filed on Aug. 9, 2018, now Pat. No. 10,412,484.

(30) Foreign Application Priority Data

Aug. 29, 2017 (KR) ..... 10-2017-0109615

(51) Int. Cl.

| | |
|---|---|
| ***H04R 1/00*** | (2006.01) |
| ***H04R 1/34*** | (2006.01) |
| ***H04R 1/02*** | (2006.01) |

(52) U.S. Cl.

CPC ..... *H04R 1/345* (2013.01); *H04R 1/025* (2013.01)

(58) Field of Classification Search

CPC ... H04R 1/20; H04R 1/22; H04R 1/30; H04R 1/32; H04R 1/323; H04R 1/345; H04R 1/403

See application file for complete search history.

(56) References Cited

U.S. PATENT DOCUMENTS 2,789,651 A * 4/1957 Daniels ..... H04R 1/342 381/338
9,451,355 B1 * 9/2016 Jankovsky ..... H04R 1/345
(Continued)

FOREIGN PATENT DOCUMENTS

CN 203840539 U 9/2014
JP 2007-243534 A 9/2007
(Continued)

OTHER PUBLICATIONS

International Search Report dated Dec. 12, 2018 by the International Searching Authority in counterpart International Patent Application No. PCT/KR2018/009028. (PCT/ISA/210).
(Continued)

*Primary Examiner* — Matthew A Eason
(74) *Attorney, Agent, or Firm* — Sughrue Mion, PLLC

(57) ABSTRACT

A speaker apparatus includes a sound guide and a pair of speakers mounted to the sound guide. The sound guide includes a first guide portion configured to guide a sound generated from any one of the pair of speakers in a first direction; and a second guide portion configured to guide a sound generated from the other speaker in a second direction that is plane-symmetric with respect to the first direction. Each of the first and second guide portions includes an opening forming portion formed in an end portion of the corresponding portion and including an opening configured to output a sound generated by the pair of speakers, and a slit forming portion including a slit configured to output a sound, together with the opening, wherein the slit is extended from one side of the opening.

15 Claims, 9 Drawing Sheets

(56) References Cited

U.S. PATENT DOCUMENTS

| | | | | |
|---|---|---|---|---|
| 2009/0274329 | A1* | 11/2009 | Ickler | G10K 11/26 381/338 |
| 2010/0260369 | A1 | 10/2010 | Suzuki | |
| 2011/0026744 | A1 | 2/2011 | Jankovsky et al. | |
| 2011/0219936 | A1* | 9/2011 | Masuda | G10D 7/00 84/330 |
| 2012/0121118 | A1* | 5/2012 | Fregoso | H04R 1/36 381/337 |
| 2012/0263333 | A1 | 10/2012 | Akino | |
| 2013/0058513 | A1 | 3/2013 | Miyamoto et al. | |
| 2017/0055069 | A1 | 2/2017 | Lee et al. | |
| 2018/0167724 | A1* | 6/2018 | Jung | H04R 1/345 |

FOREIGN PATENT DOCUMENTS

| | | | |
|---|---|---|---|
| JP | 2011-520354 | A | 7/2011 |
| JP | 2015-002559 | A | 1/2015 |

OTHER PUBLICATIONS

Written Opinion dated Dec. 12, 2018 by the International Searching Authority in counterpart International Patent Application No. PCT/KR2018/009028. (PCT/ISA/237).

Notification dated Dec. 12, 2018 by the International Searching Authority in counterpart International Patent Application No. PCT/KR2018/009028. (PCT/ISA/220).

* cited by examiner

SPEAKER APPARATUS

CROSS-REFERENCE TO RELATED APPLICATION(S)

This application is a continuation of U.S. application Ser. No. 16/059,648, filed on Aug. 9, 2018, in the U.S. Patent and Trademark Office, which is based on and claims priority under 35 U.S.C. § 119 from Korean Patent Application No. 10-2017-0109615, filed on Aug. 29, 2017, in the Korean Intellectual Property Office, the disclosures of which are incorporated herein by reference in their entireties.

BACKGROUND

1. Field

The disclosure relates to a speaker apparatus, and more particularly, to a speaker apparatus that has a highly directional structure.

2. Description of Related Art

Generally, a speaker is a device that generates a sound by converting an electrical signal into a vibration of a vibrating portion.

In a conventional manner, a speaker is a device that simply generates a sound. With the progress of technology, a multi-channel speaker apparatus has been realized through a plurality of speakers, so that a listener can receive more optimized sound.

However, in the case of implementing multiple channels through the plurality of speakers, there are space limitations, and there is a disadvantage that the plurality of speakers must be rearranged in order to change a sweet spot.

SUMMARY

Therefore, it is an aspect of the disclosure to provide a speaker apparatus that is capable of implementing a plurality of channels.

It is another aspect of the disclosure to provide a speaker apparatus that has a wide frequency band.

It is another aspect of the disclosure to provide a speaker apparatus that is capable of radiating a certain frequency band at a certain directional angle.

Additional aspects of the disclosure will be set forth in part in the description which follows and, in part, will be apparent from the description, or may be learned by practice of the disclosure.

In accordance with an aspect of the disclosure, a speaker apparatus includes a sound guide; and a pair of speakers mounted to the sound guide. The sound guide includes a first guide portion configured to guide a first sound emitted by a first speaker from among the pair of speakers in a first direction; and a second guide portion configured to guide a second sound emitted by a second speaker from among the pair of speakers in a second direction that is plane-symmetric with respect to the first direction. Each of the first and second guide portions includes an opening forming portion formed in an end portion of a corresponding one of the first and second guide portions including an opening configured to output a respective sound emitted by a corresponding one of the pair of speakers, to an outside of the sound guide; and a slit forming portion including a slit configured to output of the respective sound, wherein the slit extends from one side of the opening.

The opening and the slit may be formed to facilitate a changing of a distance (r) between the corresponding one of the pair of speakers and the opening or the slit, according to a radiation direction (a) of the sound emitted by the corresponding one of the pair of speakers.

A first distance (r1) in a first radiation direction (a1) from the corresponding one of the pair of speakers toward a first point in the opening and the slit, may be shorter than a second distance (r2) in a second radiation direction (a2) toward a second point that is located further than the first point with respect to the corresponding one of the pair of speakers.

A variation of the distance (r) as a function of a variation of an angle between a horizontal axis with respect to the corresponding one of the pair of speakers and the radiation direction (a) may be greater in the slit than in the opening.

The slit forming portion may be disposed on a front surface of each guide portion to facilitate a transmission of a sound in a direction that is further forward than the first and second directions, and the opening forming portion may be bent with respect to the slit forming portion so as to facilitate the output of the sound.

The slit forming portion may be disposed on a front surface of each guide portion to be elongated along a longitudinal direction of the corresponding guide portion.

The speaker apparatus may further include a center speaker provided in the sound guide and configured to emit a sound toward a front side of the speaker apparatus.

The sound guide may further include a guide body to which the center speaker is mounted. A front surface of the guide body may be recessed to have a first radius of curvature so as to guide a sound emitted by the center speaker toward the front side, and each of the pair of guide portions may comprise a guide inner wall configured to guide a sound emitted by the pair of speakers and having a second radius of curvature that is greater than the first radius of curvature.

Each guide portion may comprise an interference preventing rib provided between the slit forming portion and the center speaker and configured to prevent a sound interference between the pair of speakers and the center speaker.

The first and second directions may be respectively configured to be directed to the left and right directions and inclined forwardly.

The first speaker from among the pair of speakers may be disposed to be directed toward the first direction, and the second speaker from among the pair of speakers may be disposed to be directed toward the second direction.

The slit may have a width thereof gradually increases along the longitudinal direction of the corresponding guide portion.

The slit forming portion may have a wave shape.

The sound guide may further comprise a sound reflector provided inside of the corresponding guide portion and configured to reflect a sound toward the front side of the guide portion in which the slit forming portion is disposed. The sound reflector may be formed along the first direction or the second direction such that the sound reflector has a step shape that protrudes toward the front side as a distance from the pair of speakers increases.

In accordance with another aspect of the disclosure, a speaker apparatus includes a center speaker configured to output a sound toward the front side of the speaker apparatus; a pair of speakers configured to output sound in first and second directions inclined forwardly with respect to a left and right direction; and a sound guide provided with guide portions configured to guide a sound in each of the first and second directions, and the sound guide configured to facilitate a seating of the center speaker and the pair of speakers thereon. Each of the guide portions comprises an outlet provided with an opening disposed in an end portion of the corresponding guide portion and configured to output the sound to the first or second direction; and a slit that extends from the opening and is configured to output the sound toward the front side. A distance from the pair of speakers to the outlet varies according to a radiation direction of a sound emitted by the pair of speakers.

The sound guide may have a first radius of curvature to guide a sound output from the center speaker toward the front side. The sound guide may include a guide body to which the center speaker is mounted; and a pair of guide portions provided on opposites sides of the guide body and configured to guide a sound output from the pair of speakers. The guide body may be formed such that a part of a front surface thereof has the first radius of curvature, and is configured to guide a sound output from the center speaker toward the front side. The pair of guide portions may include a guide inner wall configured to guide a sound emitted by the pair of speakers and having a second radius of curvature that is greater than the first radius of curvature.

In accordance with yet another aspect of the disclosure, a speaker apparatus includes at least one speaker; and a sound guide provided with at least one guide portion configured to guide a sound emitted by the at least one speaker, and the sound guide configured to facilitate a mounting of the at least one speaker thereon. The at least guide portion includes a slit forming portion including a slit disposed on a front surface of the at least one guide unit; and an opening forming portion including an opening that extends from the slit and is disposed on a surface different from the front surface of the at least one guide portion.

The opening forming portion may be formed on an upper surface of the at least one guide portion.

BRIEF DESCRIPTION OF THE DRAWINGS

The above and/or other aspects of the disclosure will become apparent and more readily appreciated from the following description of embodiments, taken in conjunction with the accompanying drawings of which.

DETAILED DESCRIPTION

Figure 1:
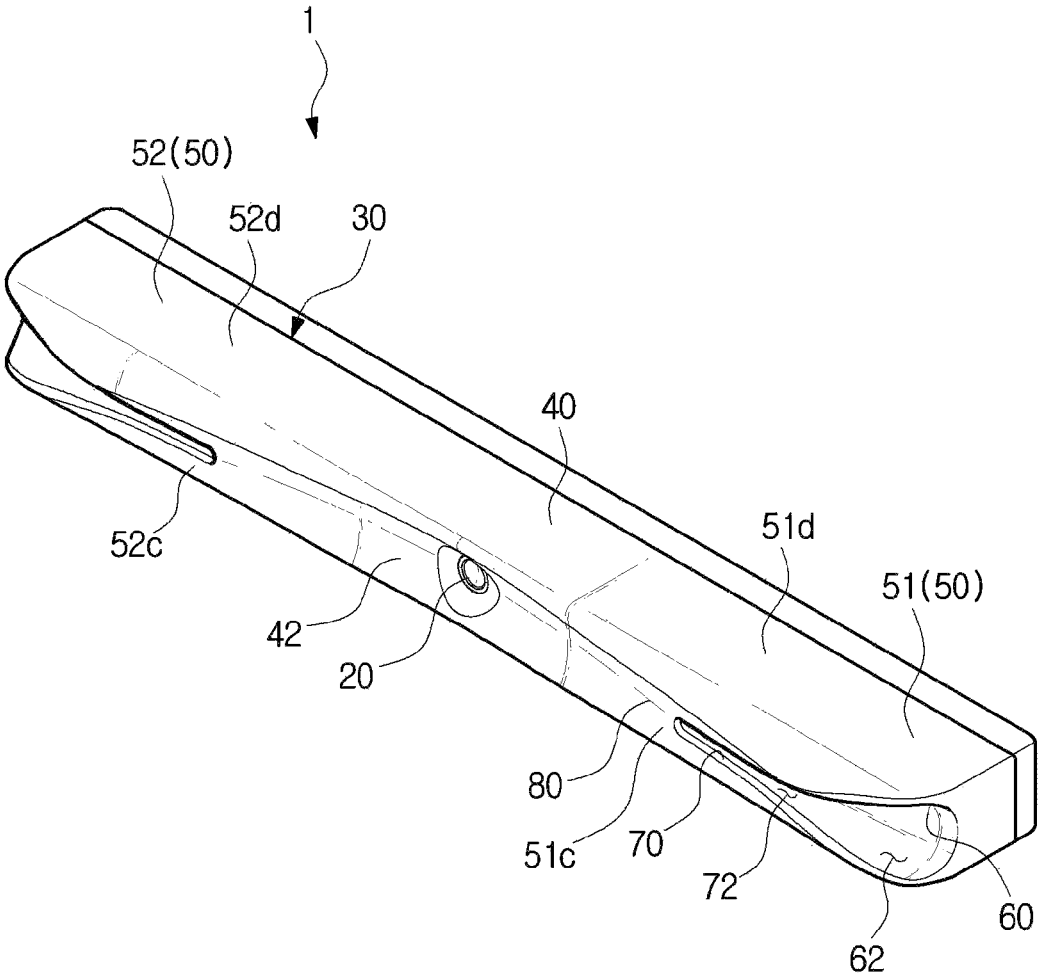
FIG. 1 is a perspective view of a speaker apparatus, according to an embodiment.

Embodiments described in the disclosure and configurations shown in the drawings are merely examples of the embodiments of the disclosure, and may be modified in various different ways at the time of filing of the present application to replace the embodiments and drawings of the disclosure.

In addition, the same reference numerals or signs shown in the drawings of the disclosure indicate elements or components performing substantially the same function.

Further, the terms used herein are used to describe the embodiments and are not intended to limit and/or restrict the disclosure. The singular forms "a," "an" and "the" are intended to include the plural forms as well, unless the context clearly indicates otherwise. In this disclosure, the terms "including", "having", and the like are used to specify features, numbers, steps, operations, elements, components, or combinations thereof, but do not preclude the presence or addition of one or more of the features, elements, steps, operations, elements, components, or combinations thereof.

It will be understood that, although the terms first, second, third, etc., may be used herein to describe various elements, but elements are not limited by these terms. These terms are only used to distinguish one element from another element. For example, without departing from the scope of the disclosure, a first element may be termed as a second element, and a second element may be termed as a first element. The term of "and/or" includes a plurality of combinations of relevant items or any one item among a plurality of relevant items.

Embodiments will be described more fully hereinafter with reference to the accompanying drawings.

Figure 2:
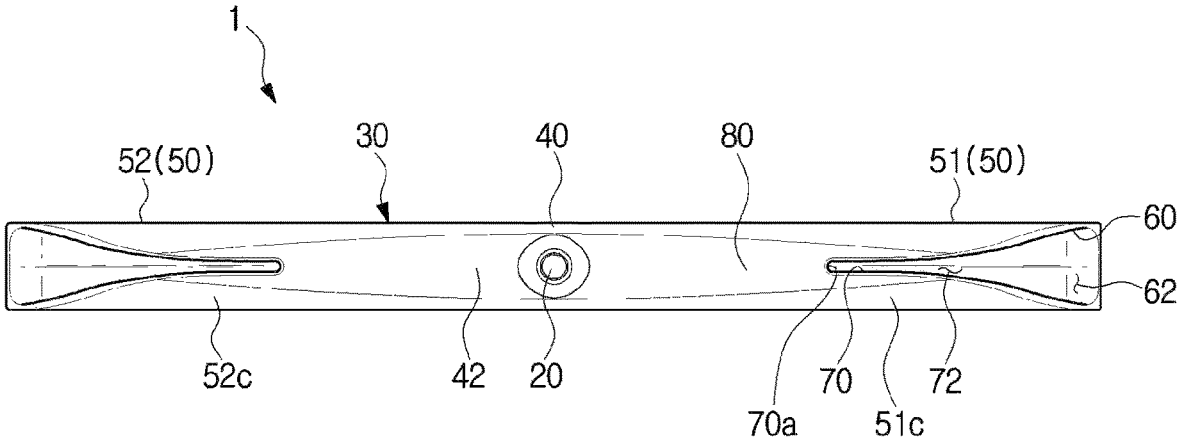
FIG. 2 is a front view of the speaker apparatus, according to an embodiment.
Figure 3:
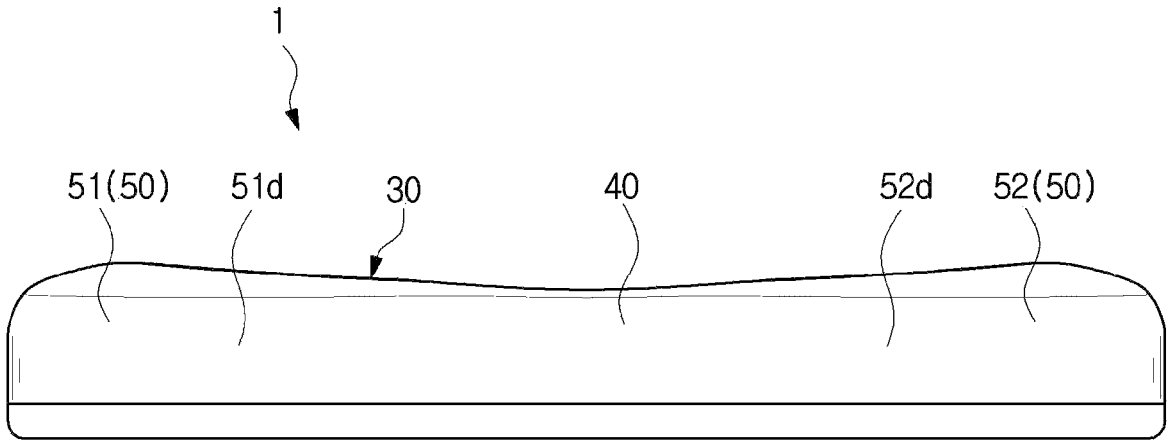
FIG. 3 is a top plan view of the speaker apparatus, according to an embodiment.
Figure 4:
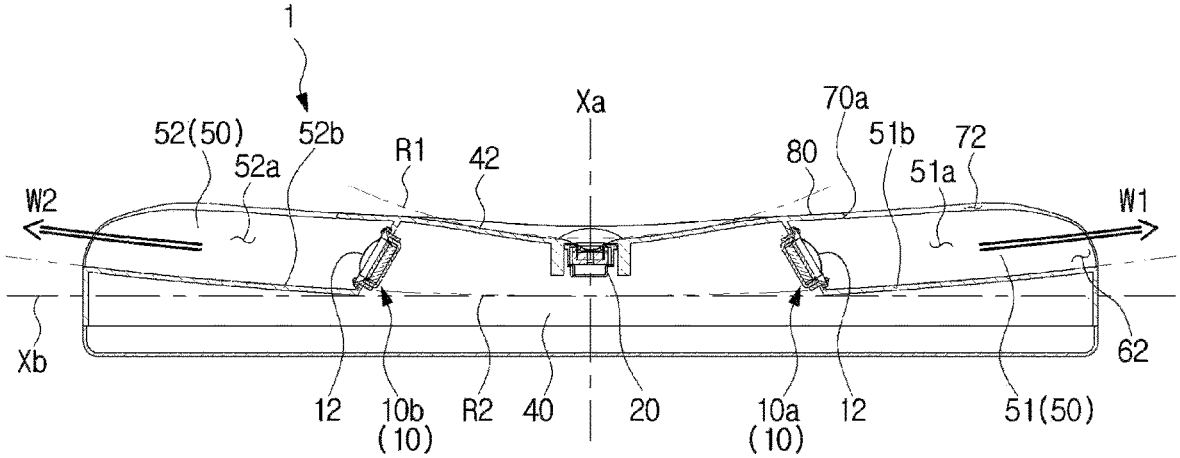
FIGS. 4 and 5 are sectional views of the speaker apparatus, according to an embodiment.
Figure 5:
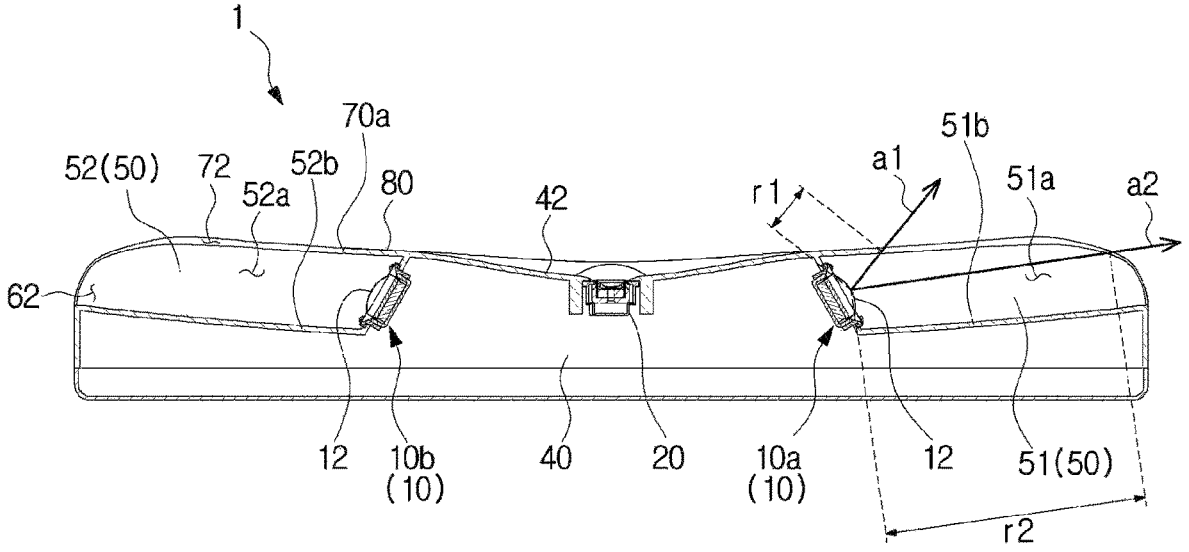

FIG. 1 is a perspective view of a speaker apparatus, according to an embodiment; FIG. 2 is a front view of the speaker apparatus, according to an embodiment; FIG. 3 is a top plan view of the speaker apparatus, according to an embodiment; and FIGS. 4 and 5 are sectional views of the speaker apparatus, according to an embodiment.

The speaker apparatus 1 includes a speaker 10 and a sound guide 30 that guides a sound that is generated by and emitted from the speaker 10. The speaker apparatus 1 may be formed in a bar shape.

The speaker 10 is a device configured to convert an electrical signal into a vibration of a vibrating portion 12 so as to generate a sound. The speaker 10 includes a magnetic circuit (not shown) and a vibration system (not shown). The magnetic circuit portion is a portion to which an electrical signal is transmitted so as to generate a sound to the speaker 10. The magnetic circuit portion includes a magnet and a pole piece disposed at the center of the magnet. The vibration system is a portion in which a sound is generated and outputted as a vibration. The vibration system includes a voice coil provided in a gap disposed between the magnet and the pole piece, a bobbin in which the voice coil is installed, and a vibrating portion 12 configured to be movable by a magnetic circuit disposed in the magnetic circuit portion.

With this configuration, the speaker 10 may convert an electrical signal into a vibration of the vibrating portion 12 and generate dilatational waves to the air through the vibration, thereby generating the sound.

A pair of speakers 10 may be provided and may be arranged symmetrically with respect to each other. In particular, the pair of speakers 10 may be arranged in a manner that has planar symmetry with respect to a center (Xa) of the speaker apparatus 1. The pair of speakers 10 may be arranged to be inclined forwardly with respect to the left-right directional axis (i.e., a longitudinal axis of the speaker apparatus 1).

The sound guide 30 is configured to guide the sound generated by and emitted from the speaker 10, wherein the speaker 10 is disposed in the sound guide 30.

The sound guide 30 may include a guide body 40.

The speaker 10 (refer to FIG. 4) may be disposed in the guide body 40. Since the speaker 10 is provided in a pair, the pair of speakers 10 may be arranged symmetrically with respect to a length of the guide body 40.

The sound guide 30 may include at least one guide unit (also referred to herein as a "guide portion") 50. The guide body 40 and the guide unit 50 may be integrally formed. In this embodiment, since the pair of speakers 10 is provided, a pair of the guide units (guide portions) 50 is also provided on opposite sides of the guide body 40, but is not limited thereto. Alternatively, a plurality of speakers 10 may be provided and a plurality of guide units (guide portions) 50 may be provided along a perimeter of the guide body 40.

The at least one guide unit 50 is configured to guide the sound, which is generated from the vibrating portion 12 of the speaker 10, to the outside of the speaker apparatus 1. The at least one guide unit 50 may include a first guide unit 51 configured to guide a sound generated from one of the pair of speakers 10, and a second guide unit 52 configured to guide a sound generated from the other of the pair of the speakers 10. For convenience of description, one of the speakers 10 is referred to as a first speaker 10*a* and the other of the speakers 10 is referred to as a second speaker 10*b*.

The first guide unit 51 may guide a sound generated from the first speaker 10*a* in a first direction w1 (referring to FIG. 4), and the second guide unit 52 may guide a sound generated from the second speaker 10*b* in a second direction w2 (referring to FIG. 4).

The first and second directions w1 and w2 are plane-symmetrical with respect to the center of the speaker apparatus 1. In this aspect, the first and second directions are configured to guide the sound generated by and emitted from the speakers 10 to the opposite sides, an in particular, to guide the sound in a direction that is forwardly inclined, in order to allow the sound to be reflected by a wall or a reflective surface, so that a listener located in front of the speaker apparatus 1 can listen to the sound.

Each guide unit 50 may include an outlet forming portion configured to form an outlet, wherein the outlet is configured to guide a sound which is generated from the vibrating portion 12 of the speaker 10, and then to output the sound to the outside of the speaker apparatus 1.

The outlet may include an opening 62 and a slit 72, and the outlet forming portion may include an opening forming portion 60 and a slit forming portion 70.

The opening 62 is configured to allow the sound generated from the speaker 10 to be outputted to the outside of the sound guide 30. The opening forming portion 60 may form the opening 62 and may be provided at an end portion of the guide unit 50. In particular, the opening forming portion 60 may be disposed on a lateral side of the sound guide 30. In this embodiment, since the pair of speakers 10 is provided, the opening forming portion 60 may be positioned at each end of the first and second guide portions 51 and 52.

Together with the opening 62, the slit 72 may be configured to output the sound. The slit 72 may be configured to extend the opening 62. For convenience of description, the opening 62 will be firstly described, and the slit 72 will be described to extend the opening 62, but alternatively, the opening 62 may be provided to extend the slit 72. The slit 72 may extend from one side of the opening 62 toward the speaker 10. In this aspect, the slit 72 may extend from the opening 62, so as to be particularly elongated in a direction in which the speaker 10 is disposed, along a longitudinal direction of the guide unit 50.

The slit 72 may extend from the opening 62, wherein the slit 72 may be disposed on respective front surfaces 51*c* and 52*c* of the corresponding guide units 50. In this embodiment, the slit 72 may be disposed on front surfaces 51*c* and 52*c* of the guide units 50, but is not limited thereto. Alternatively, according to the environment in which the speaker apparatus 1 is disposed, the slit 72 may be disposed on upper surfaces 51*d* and 52*d* of the guide units 50.

The slit 72 and the opening 62 may be formed such that guide spaces 51*a* and 52*a* formed in the guide units 50 are exposed in mutually different directions. In this aspect, the slit 72 may be configured to expose the guide spaces 51*a* and 52*a* to the front side, and the opening 62 may be configured to expose the guide spaces 51*a* and 52*a* to the lateral side.

Through the slit 72, the inside of the guide unit 50 may be exposed to the front side of the speaker apparatus 1. The slit forming portion 70 may form the slit 72, wherein the slit forming portion 70 may be provided on the front surfaces 51*c* and 52*c* of the guide units 50. In this embodiment, since the pair of speakers 10 is provided, the slit forming portion 70 and the slit 72 may extend from the opening forming portion 60 and the opening 62 of each of the first and second guide units 51 and 52, toward the pair of speakers 10.

The slit 72 and the slit forming portion 70 may be elongated along the longitudinal direction of the guide units 50. The slit forming portion 70 may be formed such that a width of the slit 72 increases as a distance from the speaker 10 increases. However, the shape of the slit 72 and the slit forming portion 70 is not limited thereto. Alternatively, the slit forming portion 70 may be formed such that a width of the slit 72 is constant and the slit 72 is connected to the opening 62.

The opening forming portion 60 may be formed to be bent with respect to the slit forming portion 70. In particular, the opening forming portion 60 may face a lateral side of the speaker apparatus 1, and the slit forming portion 70 may be formed to face the front of the speaker apparatus 1. The opening forming portion 60 may be provided at the end portion of the guide portions 50 so that sounds guided to the first and second directions are output to the outside of the first and second guide portions 51 and 52.

Hereinafter a description will be described with reference to FIGS. 4 and 5. The opening forming portion 60 and the slit forming portion 70 may be formed such that a distance (r) from either of the pair of speakers 10 to the opening 62 or the slit 72 varies, according to a radiation direction (a) of the sound generated from the corresponding one of the pair of speakers 10.

In this aspect, when the radiation direction of the sound generated from the speaker 10 is referred to as a first radiation direction (a1) and a direction inclined backward from the first radiation direction is referred to as a second radiation direction (a2), a distance (r1) from the speaker 10 to the outlet in the first radiation direction (a1) may be less than a distance (r2) from the speaker 10 to the outlet in the second radiation direction (a2), wherein the first radiation direction (a1) is a direction toward a first point of the opening 62 and the slit 72, and the second radiation direction (a2) is a direction toward a second point that is located further than the first point of the opening 62 and the slit 72 with respect to the speaker.

In particular, as the sound radiation direction from the speaker 10 goes forward, the sound may pass the outlet with a shorter distance, and conversely, as the sound radiation direction from the speaker 10 goes rearward, the sound may pass the outlet with a relatively longer distance.

The variation of the distance (r), which is a function of the variation of an angle (θ) between a virtual horizontal axis with respect to the speaker 10 and the radiation direction (a), may be greater in the opening 62 than in the slit 72. Particularly, since the slit 72 is disposed along the longitudinal direction of the guide unit 50, the distance (r) may be increased in inverse proportion, as the angle (θ) is reduced. Since the opening 62 is disposed on the end portion of the guide unit 50, a rate of distance (r) change between the opening 62 and the speaker 10 may be less than a rate of change in the slit 72, as the angle (θ) is smaller.

In this embodiment, in the slit forming portion 70, a distance (rm) between a portion adjacent to the center of the speaker apparatus 1 and the speaker 10 is the shortest and a distance (rM) between an outer peripheral portion of the opening forming portion 60 and the speaker 10 is the longest.

As mentioned above, since a distance from the speaker 10 to the outlet varies according to the radiation direction, it may be possible to transmit a relatively wide frequency band to the outside of the speaker apparatus 1. At a point in which the distance (r) is at a minimum (i.e., r=rm), it may be possible to output a sound in a frequency band that is lower than at a point in which the distance (r) is at a maximum (i.e., r=rM).

The speaker apparatus 1 may include a center speaker 20.

The center speaker 20 may be provided between the pair of guide units 50. The center speaker 20 may be mounted to the guide body 40 to output the sound toward the front of the speaker apparatus 1.

In this embodiment, a single center speaker 20 is provided, but the number of the center speakers is not limited. Alternatively, a pair of center speakers 20 may be provided and arranged symmetrically with respect to the center of the speaker apparatus 1.

The center speaker 20 and the pair of speakers 10 may be configured to output sounds of different frequency bands. The pair of speakers 10 may output sound that has a frequency band which is higher than that of the center speaker 20. The center speaker 20 and the pair of speakers 10 may output sound without the interruption of the frequency band. Further, since the frequency bands of sounds output from the center speaker 20 and the pair of speakers 10 are different, the spatial feeling of the sound experienced by a listener can be improved, and the optimum sound can be provided to the listener.

For example, the center speaker 20 may output a sound having a frequency band of 100 Hz or from 1 kHz to 3 kHz, and the pair of speakers 10 may output a sound having a frequency band of from 3 kHz to 10 kHz. As mentioned above, the frequency of the sound output from the opening 62 and the slit 72 of the guide unit 50 may vary according to the angle with respect to the speaker 10. In particular, a sound having a frequency band of 3 kHz may be output from a portion of the slit 72 adjacent to the speaker 10, and a sound having a frequency band of 10 kHz may be output from the opening 62. As the sound goes toward the point at which a distance between the speaker 10 and the outlet is at a maximum (i.e., r=rM), from the point at which a distance between the speaker 10 and the outlet is at a minimum (i.e., r=rm), the frequency band of the output sound may be gradually increased. However, the magnitude of the frequency band of the sound output from the center speaker 20 and the pair of speakers 10 is not limited thereto.

Each guide unit 50 may include an interference preventing rib 80.

The interference preventing rib 80 is configured to reduce and/or prevent interference between the sound output from the pair of speakers 10 and the sound output from the center speaker 20. The interference preventing rib 80 may be disposed on the front surfaces 51*c* and 52*c* of the guide units 50. In the slit forming portion 70, the interference preventing ribs 80 may be disposed between the central speaker 20 and a portion 70*a* adjacent to the speaker 10. By minimizing the interference between a radiation range of the sound output from the center speaker 20 and a radiation range of the sound output from the guide unit 50, it may be possible to increase the sound quality that is detected in the "sweet spot" (i.e., an area in which the sound quality is optimal). The interference preventing rib 80 may be configured to prevent the pair of speakers 10 from being exposed to the front side of the speaker apparatus 1. Accordingly, the sound generated from the center speaker 20 may be output to the front side of the speaker apparatus 1, and the sound generated from the pair of speakers 10 may be output to the lateral side in a forwardly inclined direction with respect to the speaker apparatus 1.

A front surface 42 of the guide body 40 in which the center speaker 20 is disposed may be recessed to have a first radius of curvature (R1) in the left and right direction. The sound output from the center speaker 20 may be guided toward the front side of the speaker apparatus 1 by the front face 42 of the guide body 40 having the first radius of curvature R1. Since the front face 42 of the guide body 40 is formed to have the first radius of curvature R1, the sound may be effectively output from the center speaker 20 to the sweet spot.

Guide inner walls 51*b* and 52*b* forming the guide spaces 51*a* and 52*a* of the guide units 50 may be formed to have a second radius of curvature R2 that is greater than the first radius of curvature R1. By virtue of the guide units 50 having the second radius of curvature R2, the sound output from the pair of speakers 10 may be guided to the lateral side of the speaker apparatus 1, and in particular, the sound may be guided so as to be inclined with respect to the front side of the speaker apparatus 1. The guide inner walls 51*b* and 52*b* may be inclined to the front side with respect to a left-right direction axis (i.e., a horizontal axis) (Xb). An angle between the left-right direction axis (Xb) and the guide inner walls 51*b* and 52*b* is not limited thereto. In this embodiment, the guide inner walls 51*b* and 52*b* may be forwardly inclined by 20 degrees with respect to the left-right direction axis (Xb).

The front surface 42 of the guide body 40 may be formed such that a central portion thereof is concave with respect to the upper and lower portions. With this configuration and the above mentioned configuration in which the front surface 42 of the guide body 40 is concavely formed to have the first radius of curvature R1 in the left-right direction, it may be possible to effectively output the sound generated from the center speaker 20 toward the front side of the speaker apparatus 1.

Figure 6:
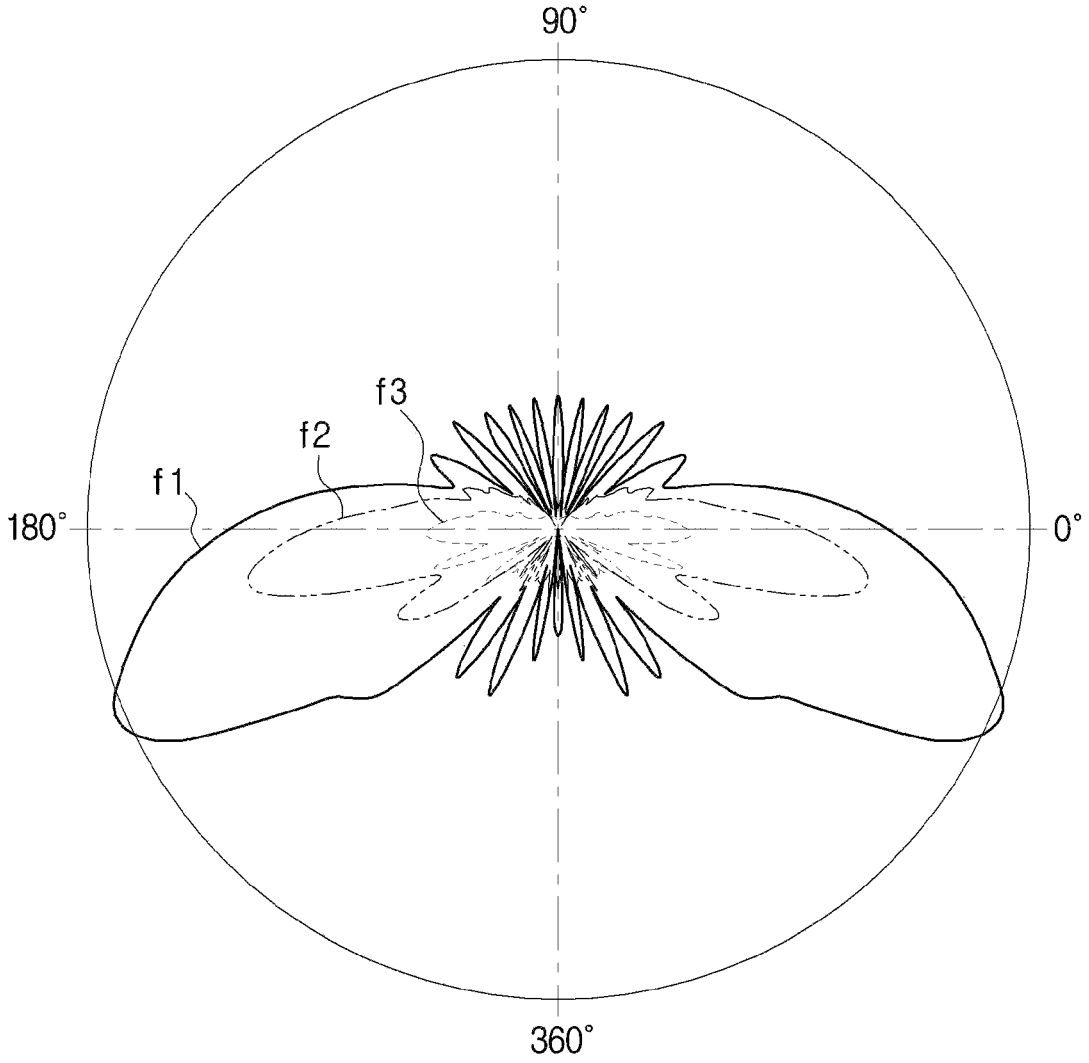
FIG. 6 is a graph schematically illustrating a difference in a directional angle range according to a frequency in the speaker apparatus, according to an embodiment.

FIG. 6 is a graph schematically illustrating a difference in a directional angle range according to a frequency in the speaker apparatus, according to an embodiment.

FIG. 6 illustrates the difference in the directional angle range according to a certain frequency in the sound output from the speaker 10 of the speaker apparatus. For convenience of description, the first, second and third frequencies f1, f2 and f3 are illustrated, but is not limited thereto.

The first, second, and third frequencies f1, f2, and f3 may be higher frequencies in order (i.e., f1<f2 and f2<f3).

The center of the graph corresponds to the position of the speaker 10 from which the sound is output, and a lower part in the graph corresponds to the front of the speaker apparatus 1. As illustrated in the graph, the lower the frequency, the larger the range of the directional angle that may be formed. In contrast, the higher the frequency, the narrower the range of the directional angle that may be formed. Since the range of the directional angle varies according to the magnitude of the frequency, it may be possible to change the frequency of sound output from each point of the outlet. By changing the range of the directional angle according to the magnitude of the frequency band, the slit 72 may output a sound having a frequency band that is lower than a sound that is outputted from the opening 62.

Hereinafter a speaker apparatus according to another embodiment will be described. A description of the same configuration as that described above will be omitted.

Figure 7:
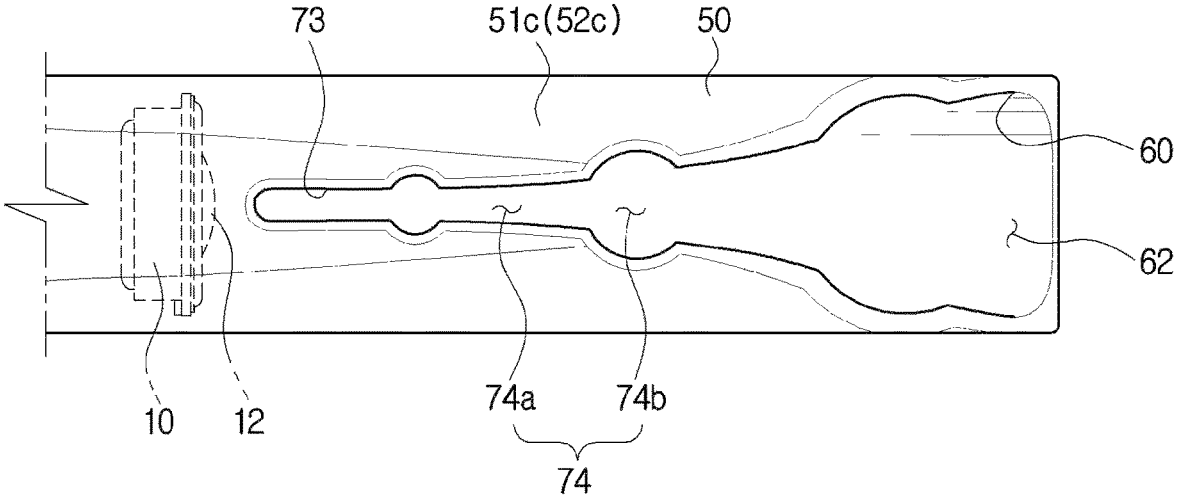
FIG. 7 is an enlarged view of a guide unit in a speaker apparatus, according to another embodiment.

FIG. 7 is an enlarged view of a guide unit in a speaker apparatus, according to another embodiment.

An outlet may include an opening 62 and a slit 74, and an outlet forming portion may include an opening forming portion 60 and a slit forming portion 73.

Together with the opening 62, the slit 74 may be configured to output the sound. The slit 74 may extend from one side of the opening 62 toward a speaker 10. The slit 74 may extend from the opening 62, wherein the slit 74 may be disposed on respective front surfaces 51*c* and 52*c* of a corresponding guide unit 50. The slit forming portion 73 may form the slit 74, wherein the slit forming portion 73 may be provided on the respective front surfaces 51*c* and 52*c* of the corresponding guide unit 50. In this embodiment, since a pair of speakers 10 is provided, the slit forming portion 70 and the slit 72 may extend from the opening forming portion 60 and the opening 62 of each of the first and second guide portion 51 and 52, toward the corresponding one of the pair of speakers 10.

The slit forming portion 73 may be formed in a wave shape. The slit 74 may include a reduced slit 74*a* and an extended slit 74*b* which is formed to be larger than a width of the adjacent reduced slit 74*a*. At least one reduced slit 74*a* and extended slit 74*b* may be provided, and in this aspect, a plurality of reduced slits 74*a* and the extended slits 74*b* may be alternately disposed along a longitudinal direction of the guide unit 50. Since the width of the extended slit 74*b* is larger than the width of the reduced slit 74*a*, the extended slit 74*b* may more smoothly output a sound in a certain band than a sound in an adjacent frequency band.

Hereinafter a speaker apparatus according to another embodiment will be described. A description of the same configuration as that described above will be omitted.

Figure 8:
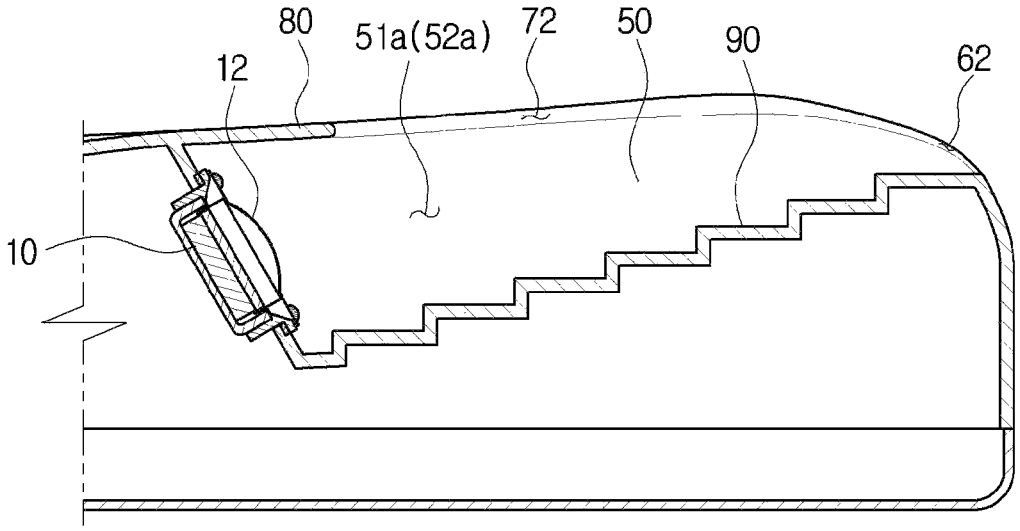
FIG. 8 is an enlarged view of a guide unit in a speaker apparatus, according to another embodiment.

FIG. 8 is an enlarged view of a guide unit in a speaker apparatus, according to another embodiment.

A sound guide 30 may include a sound reflector 90.

The sound reflector is disposed inside a guide unit 50 and configured to reflect and scatter a sound generated from a pair of speakers 10 toward the front side of a speaker apparatus 1.

The sound reflector 90 may be formed to protrude toward respective front surfaces 51*c* and 52*c* of the guide units 50 as being toward an end portion of the guide unit 50. In this embodiment, the sound reflector 90 may be formed in a step shape as being positioned toward the respective front surfaces 51*c* and 52*c* of the guide units 50 and as being positioned toward the end portions of the guide units 50.

With the configuration illustrated in FIG. 8, it may be possible to effectively transmit the sound to the front of the speaker apparatus 1 by reflecting the sound in a certain frequency band toward the front side of the speaker apparatus 1.

Hereinafter a speaker apparatus according to another embodiment will be described. A description of the same configuration as that described above will be omitted.

Figure 9:
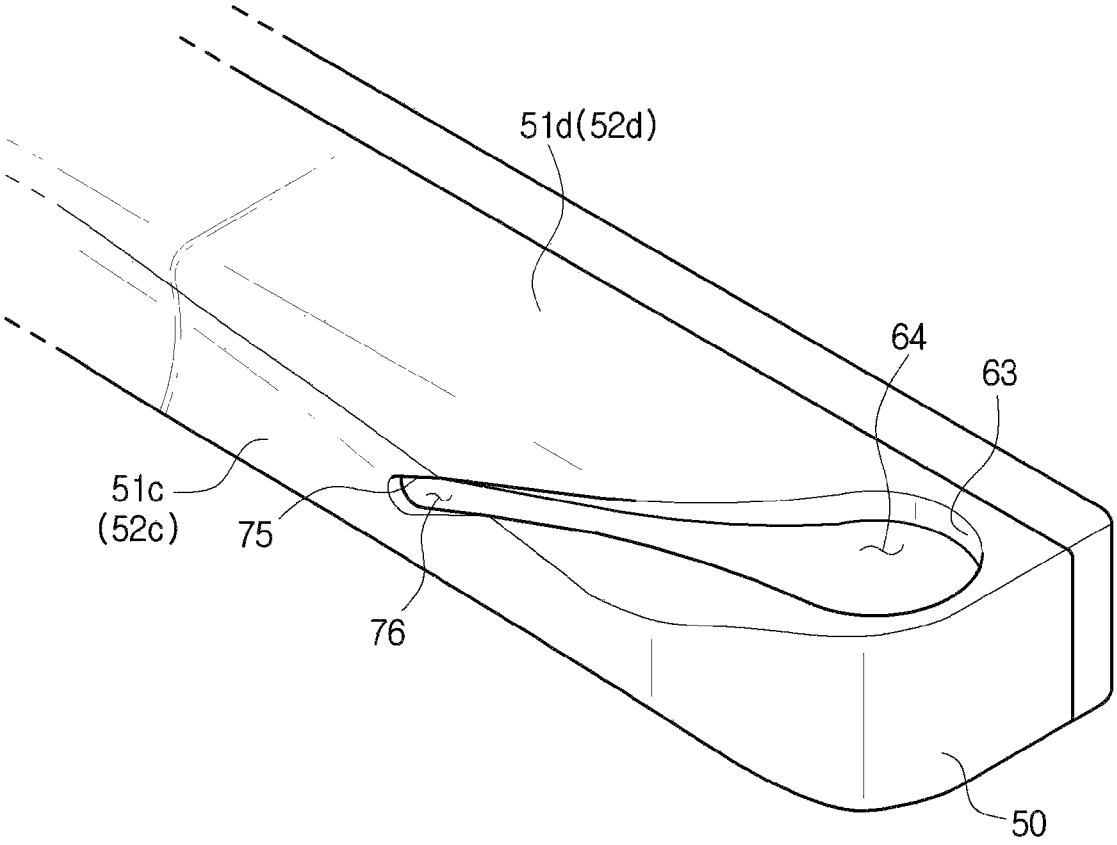
FIG. 9 is an enlarged view of a guide unit in a speaker apparatus, according to another embodiment.

FIG. 9 is an enlarged view of a guide unit in a speaker apparatus, according to another embodiment.

A guide unit 50 may include an outlet forming portion configured to form an outlet, wherein the outlet is configured to guide a sound generated from a vibrating portion 12 of a speaker 10 so as to output the sound to the outside of the speaker apparatus 1.

The outlet may include an opening 64 and a slit 76, and the outlet forming portion may include an opening forming portion 63 and a slit forming portion 75.

The slit 76 may be provided on respective front surfaces 51*c* and 52*c* of corresponding guide units 50. The slit 76 may be formed along a longitudinal direction of each guide unit 50. The slit 76 may be formed such that guide spaces 51*a* and 52*a* of the guide units 50 are exposed toward the front side of the speaker apparatus 1. The slit forming portion 75 may form the slit 76, wherein the slit forming portion 75 may be provided on the front surfaces 51*c* and 52*c* of the guide units 50. In the embodiment of FIG. 8, by illustrating a part of the speaker apparatus 1, a case in which one speaker 10 and one guide unit 50 are formed has been described. However, the disclosure is not limited thereto, and at least one speaker 10 and at least one guide unit 50 may be provided.

Together with the opening 64, the slit 76 may be configured to output the sound. The slit 76 may be configured to extend the opening 64. The opening 64 may be provided to be extended from the slit 76. The opening 64 may be disposed to allow guide spaces 51*a* and 52*b* of the guide unit 50 to be exposed to an upper side of the speaker apparatus 1. That is, the slit 76 may be disposed on the front surfaces 51*c* and 52*c* of the guide unit 50, and the opening 64 may be disposed on upper surfaces 51*d* and 52*d*. The slit 76 and the opening 64 may be formed in a twist shape, with respect to the guide unit 50.

For the convenience of description, it has been described that the opening 62 is formed on the upper surfaces 51*d* and 52*d* of the guide unit 50, but is not limited thereto. Alternatively, the opening 62 may be disposed on a surface that is different from the front surfaces 51*c* and 52*c* of the guide unit 50 in which the slit 72 is formed.

As is apparent from the above description, it may be possible to provide a sound that has multiple channels by using a single speaker apparatus, and thus it may be possible to provide an optimized sound to a listener.

It may be possible to provide a speaker apparatus that has a wide frequency band by improving a sound radiation structure.

It may be possible to control a space sound field for each frequency, because the directional angle varies according to each frequency.

Although a few embodiments have been shown and described, it will be appreciated by those having ordinary skill in the art that changes may be made in these embodiments without departing from the principles and spirit of the disclosure, the scope of which is defined in the claims and their equivalents.

What is claimed is:

1. A speaker apparatus comprising:

a first speaker;

a second speaker; and a sound guide to which the first speaker and the second speaker are mounted, the sound guide comprising:

a first guide portion configured to guide a first sound emitted by the first speaker in a first direction, the first guide portion forming a first opening through which the first sound exits out of the sound guide, a part of the first opening forming a first slit, and a second guide portion configured to guide a second sound emitted by the second speaker in a second direction that is substantially opposite the first direction, the second guide portion forming a second opening through which the second sound exits out of the sound guide, a part of the second opening forming a second slit.

2. The speaker apparatus of claim 1, wherein a first distance in a first radiation direction from the first speaker toward a first point in the first slit, is shorter than a second distance in a second radiation direction toward a second point in the first opening that is located further than the first point with respect to the first speaker.

3. The speaker apparatus of claim 1, wherein a first distance in a first radiation direction from the second speaker toward a first point in the second slit, is shorter than a second distance in a second radiation direction toward a second point in the second opening that is located further than the first point with respect to the second speaker.

4. The speaker apparatus of claim 1, wherein the first slit is disposed on a front surface of the first guide portion to transmit the first sound in a direction that is further forward than the first direction, and the second slit is disposed on a front surface of the second guide portion to transmit the second sound in a direction that is further forward than the second direction.

5. The speaker apparatus of claim 4, wherein the first slit is elongated along a longitudinal direction of the first guide portion and the second slit is elongated along a longitudinal direction of the second guide portion.

6. The speaker apparatus of claim 4, wherein another part of the first opening is disposed at a lateral end of the first guide portion and another part of the second opening is disposed at a lateral end of the second guide portion.

7. The speaker apparatus of claim 1, further comprising a center speaker provided in the sound guide and configured to emit a third sound toward a front side of the speaker apparatus.

8. The speaker apparatus of claim 7, wherein the sound guide further comprises:

a guide body to which the center speaker is mounted, and wherein a front surface of the guide body is recessed to have a first radius of curvature so as to guide the third sound emitted by the center speaker toward the front side, and each of the first guide portion and the second guide portion further comprises a guide inner wall configured to guide the respective sound emitted by the corresponding one of the first and second speakers and has a second radius of curvature that is greater than the first radius of curvature.

9. The speaker apparatus of claim 7, wherein each of the first guide portion and the second guide portion further comprises an interference preventing rib provided between the center speaker and the corresponding one of the first slit and the second slit and configured to prevent a sound interference between the center speaker and the corresponding one of the first speaker and the second speaker.

10. The speaker apparatus of claim 1, wherein the first direction is configured to be directed toward a leftward direction and inclined forwardly with respect to the speaker apparatus, and the second direction is configured to be directed toward a rightward direction and inclined forwardly with respect to the speaker apparatus.

11. The speaker apparatus of claim 1, wherein the first speaker is disposed to be directed toward the first direction, and the second speaker is disposed to be directed toward the second direction.

12. The speaker apparatus of claim 1, wherein each of the first slit and the second slit has a width gradually increases along a longitudinal direction of the corresponding one of the first and second guide portions.

13. The speaker apparatus of claim 1, wherein the sound guide further comprises:

a sound reflector provided inside of each of the first guide portion and the second guide portion and configured to reflect a sound toward a front side of the corresponding one of the first and second guide portions, and wherein the sound reflector is provided along the first direction or the second direction such that the sound reflector has a step shape that protrudes toward the front side as a distance from the first speaker or the second speaker increases.

14. The speaker apparatus of claim 4, wherein a remaining part of the first opening is disposed on a surface that is different from the front surface of the first guide portion.

15. The speaker apparatus of claim 14, wherein the remaining part of the first opening is disposed on an upper surface of the first guide portion to be elongated along a longitudinal direction of the first guide portion.

* * * * *